US005560092A

United States Patent [19]

Roiger

[11] Patent Number: 5,560,092

[45] Date of Patent: Oct. 1, 1996

[54] METHOD OF RENOVATING BATHS

[75] Inventor: Dieter Roiger, Furstenfeldbruck, Germany

[73] Assignee: Robert Keith Jenkinson, Doncaster, England

[21] Appl. No.: 407,613

[22] Filed: Mar. 21, 1995

[30] Foreign Application Priority Data

Mar. 29, 1994 [GB] United Kingdom ..... 9406241

[51] Int. Cl.[6] ..... B23P 6/00

[52] U.S. Cl. ..... 29/402.08; 29/402.06; 29/402.11; 4/538; 4/580; 156/94

[58] Field of Search ..... 29/401.1, 401.01, 29/402.06, 402.08, 402.09, 402.11, 890.14, DIG. 1; 4/538, 539, 580, DIG. 9; 156/94, 256, 258, 293

[56] References Cited

U.S. PATENT DOCUMENTS

| | | | |
|---|---|---|---|
| 3,931,651 | 1/1976 | Weir | 4/580 X |
| 4,043,853 | 8/1977 | Saladino | 4/538 X |
| 4,158,585 | 6/1979 | Wright | 156/94 |
| 5,026,966 | 6/1991 | Roth | 219/121.72 |
| 5,048,171 | 9/1991 | Bidwell et al. | 29/401.1 |

*Primary Examiner*—Peter Vo

*Attorney, Agent, or Firm*—Trexler, Bushnell, Giangiorgi & Blackstone, Ltd.

[57] ABSTRACT

An old bath is renovated by selecting a new bath, e.g., a plastics bath, having a tub to fit within the old tub and a surround to extend over all the surround of the old bath, cutting the surround of the new bath to suit adjacent wall surfaces when the new bath tub is centralized in the old bath tub, cutting away the old tub around old drain and overflow fittings and removing them, installing new drain and overflow fittings to suit holes cut in the new bath tub, applying insulating adhesive filler to the bottom of the old tub and the existing surround, fitting the new bath in place and connecting the new drain and overflow fittings, and loading the bath while the filler sets and adheres between the old and new baths, any joints with adjacent wall surfaces being filled with a sealant.

13 Claims, 5 Drawing Sheets

METHOD OF RENOVATING BATHS

BACKGROUND OF THE INVENTION

This invention relates to baths, more particularly to the renovation of old baths e.g., cast-iron or steel baths, without disturbing adjacent tiling and/or with little or no disturbance of existing plumbing.

The object of the invention is to provide a method of renovating an old bath and providing new drain and overflow fittings.

SUMMARY OF THE INVENTION

According to the present invention, a method of renovating an old bath comprises taking measurements of the bath tub and surround, selecting a new bath having a tub that will fit within the tub of the old bath and having a surround that will extend over all the surround of the old bath, cutting the surround of the new bath as necessary to suit any adjacent wall surface when the new bath tub is centralized in the old bath tub, cutting away the old tub around the drain and overflow fittings, removing those fittings and the cutaway portion of old tub, installing new drain and overflow fittings to suit holes cut in the new bath tub, applying insulating adhesive filler to at least the existing surround, fitting the new bath in place and connecting the new drain and overlow fittings to the new bath tub, and loading the new bath while the filler sets and adheres between the old and new baths.

Cutting away of the old tub may be confined closely to the area around the drain and overflow fittings, and insulating adhesive filler may be applied inside the bottom of the old tub (as well as to the existing surround) before the new bath is fitted in place.

The new bath is preferably made of plastics, e.g., acrylic, and the insulating adhesive filler is preferably curable polyurethane foam, affording both heat and noise insulation.

When the old bath is located against both a side wall and an end wall, then a side and an end of the surround of the new bath will require cutting to fit against those walls with the tub of the new bath centralized in the tub of the old bath. In the case of an old bath fitting within an alcove, both ends of the surround of the new bath will require cutting, as well as one side.

More of the old tub may be cut away, e.g., when the tub of the new bath is provided with fittings for a whirlpool or massage system, which fittings could not be accommodated between the old tub and the new tub, and insulating adhesive filler may be applied to remaining inner areas of the sides of the old tub (as well as to the existing surround) before the new bath is fitted in place.

The holes in the tub of the new bath for the drain and overflow fittings are preferably cut on site, the positions for the holes for the new drain and overflow fittings being transferred to the new bath tub after cutting the surround of the new bath as necessary to allow for centralizing of the new bath tub in the old.

Any new bath is also suitable for renovating an old bath without cutting away the old tub around the existing drain and overflow fittings, the positions for holes to register with these drain and overflow fittings being transferred from the old bath tub to the new bath tub after cutting the surround of the new bath as necessary for centralizing the new bath tub in the old bath tub, gaskets being provided between the tubs round the holes.

Loading of the new bath is conveniently effected by filling its tub with water; then, once the new bath has set in place, any joints with adjacent wall surfaces can be filled with a sealant.

BRIEF DESCRIPTION OF THE DRAWINGS

A method of renovating an old bath in accordance with the invention will now be described, by way of example only, with reference to the accompanying drawings, in which.

DETAILED DESCRIPTION OF THE INVENTION

Figure 1:
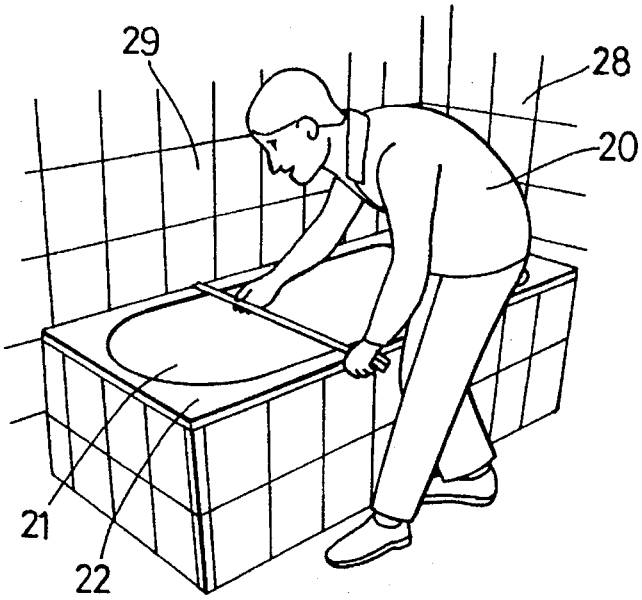
FIG. 1 to 12 are diagrammatic sketches illustrating successive steps of the method of bath renovation in accordance with the present invention.
Figure 2:
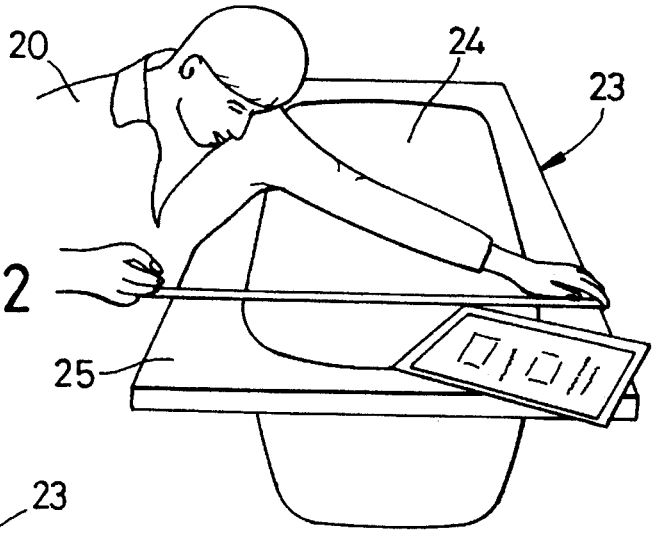

In FIG. 1, an operator 20 is seen taking measurements of an old bath tub 21 and its surround 22, which enables him to select a new bath 23 (FIG. 2) having a tub 24 that will fit within the tub 21 of the old bath and having a surround 25 that will extend over all the surround 22 of the old bath.

Figure 3:
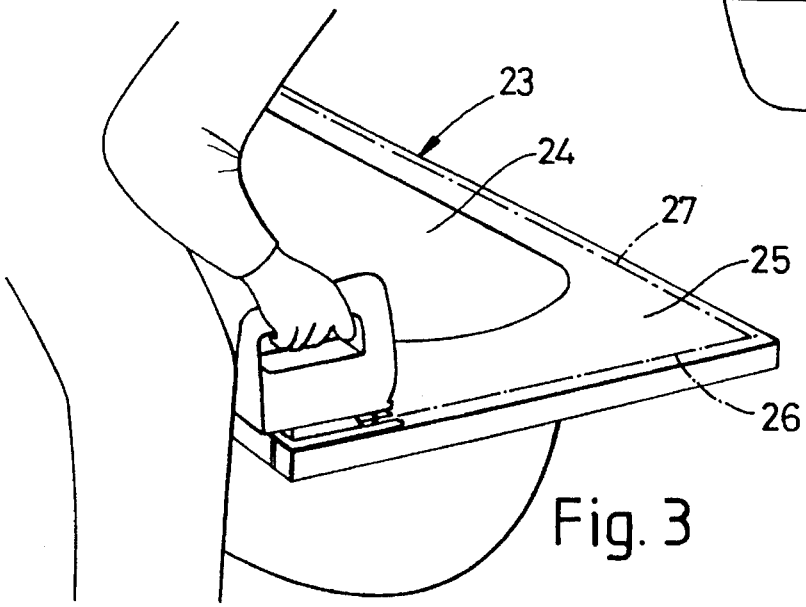
Figure 4:
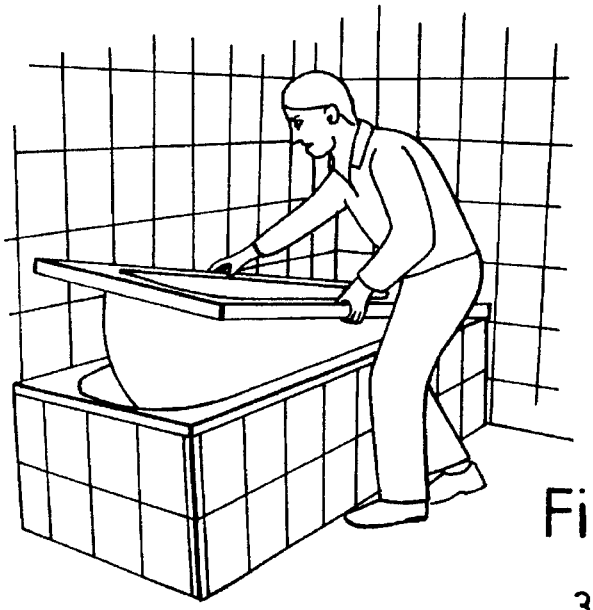

Next, the surround 25 of the new bath 23 is cut along lines 26 and 27 (as shown in FIG. 3) to suit the adjacent wall surfaces 28 and 29 respectively (see FIGS. 1, 4 to 7, 11 and 12) when the new bath tub 24 is centralized in the old bath tub 21. FIG. 4 shows the operator 20 trying the new bath in place in the old bath.

Figure 5:
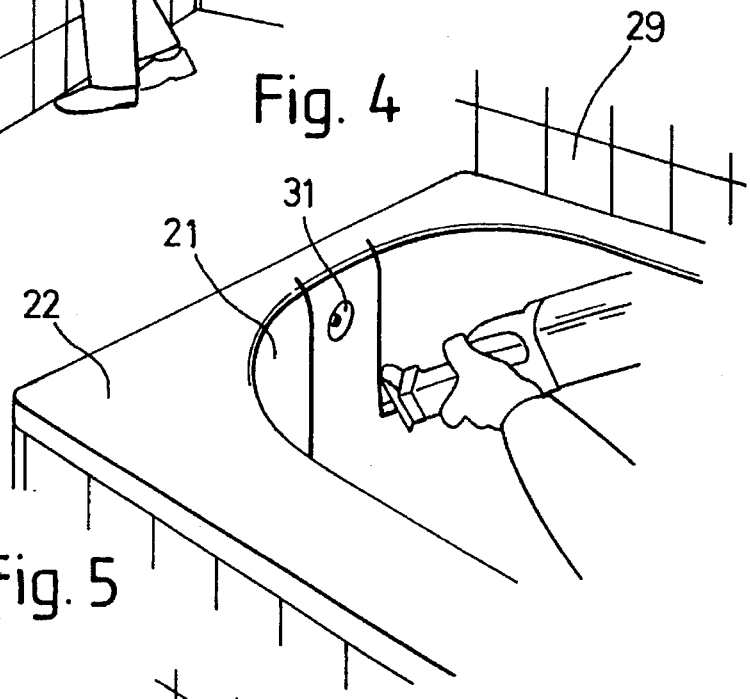
Figure 6:
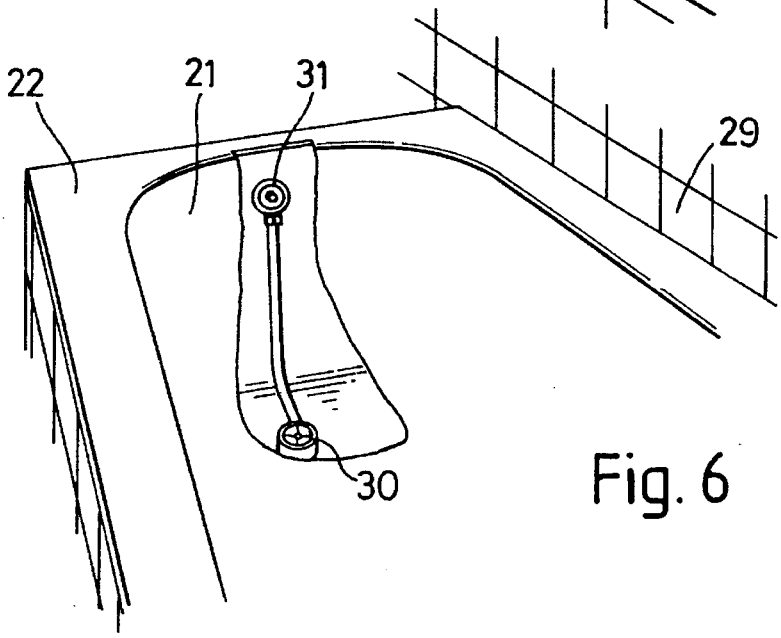
Figure 7:
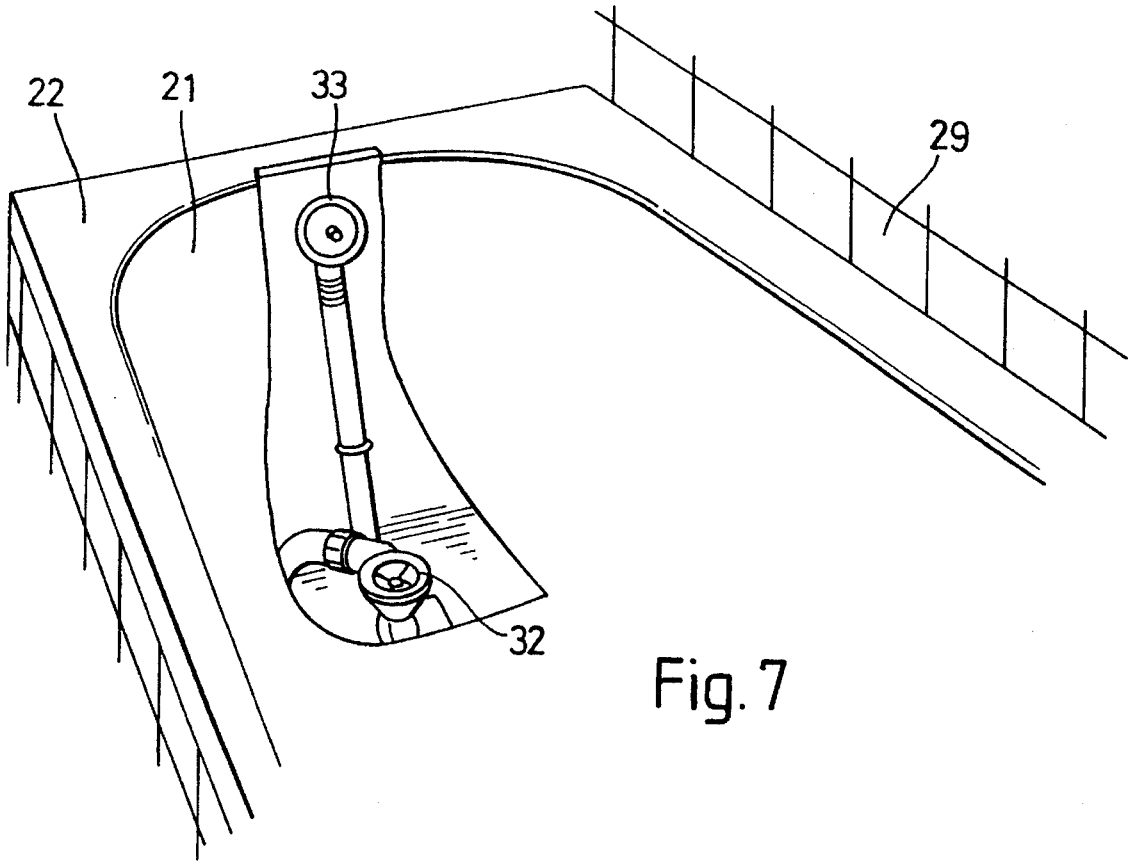

The new bath is then put on one side while the old tub 21 is cut away (as shown by FIGS. 5 and 6) around the drain and overflow fittings 30, 31, which are then removed and replaced by new fittings 32, 33 (see FIG. 7).

Figure 8:
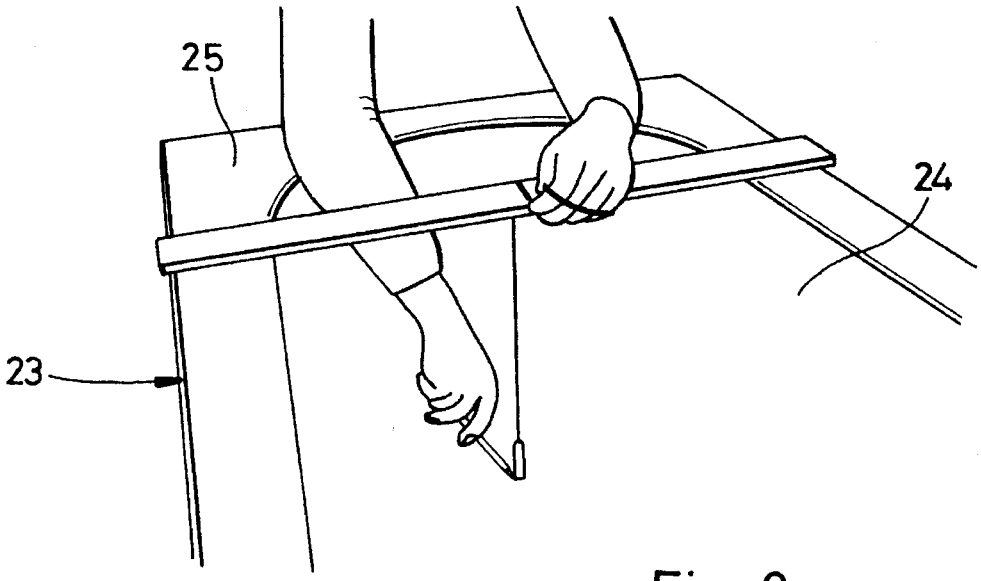
Figure 9:
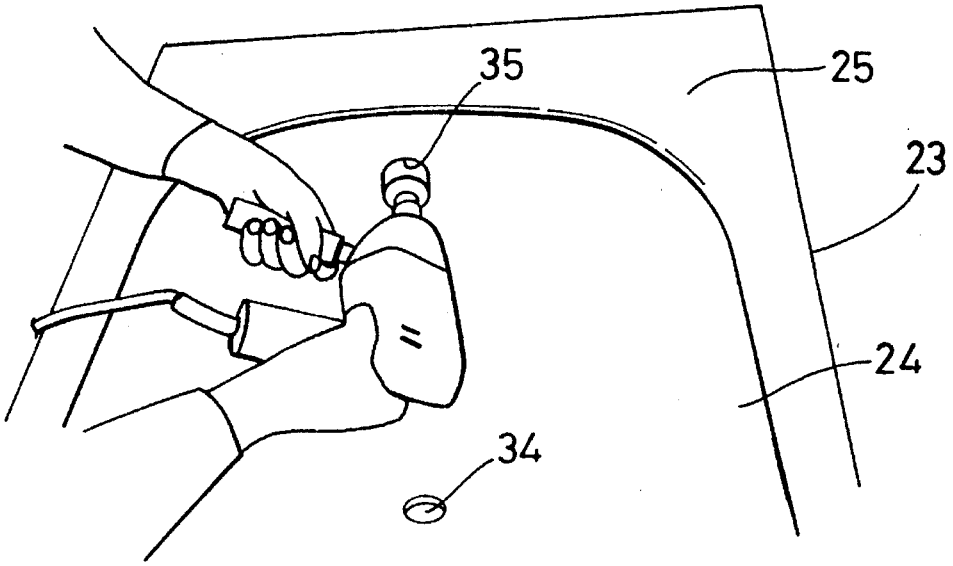

Now the new bath tub 24 is prepared for fitting into the old tub 21 by transposing the position of the drain 32 on to the bottom of the new tub (as indicated by FIG. 8) and likewise the position of the overflow 33 on to the end of the new bath tub, and holes 34, 35 to suit the new drain and overflow fittings are cut in the new tub (as illustrated in FIG. 9).

Figure 10:
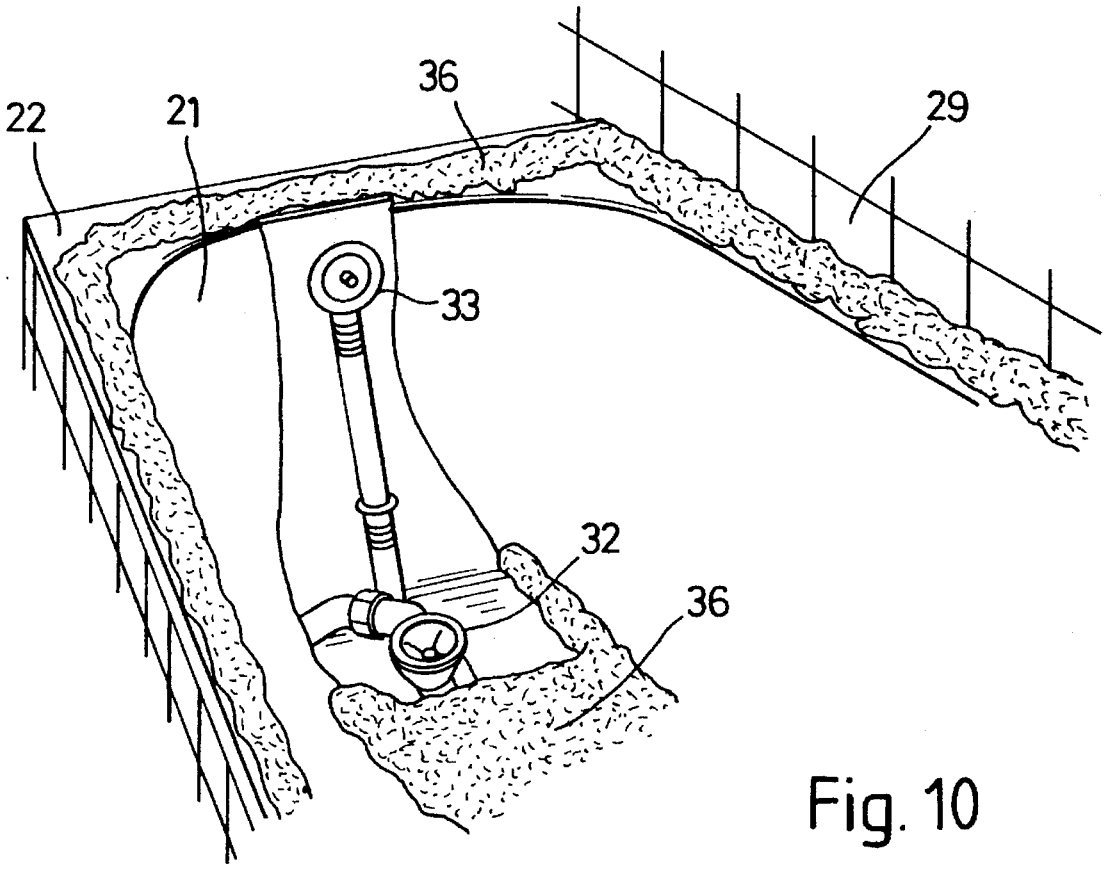
Figure 11:
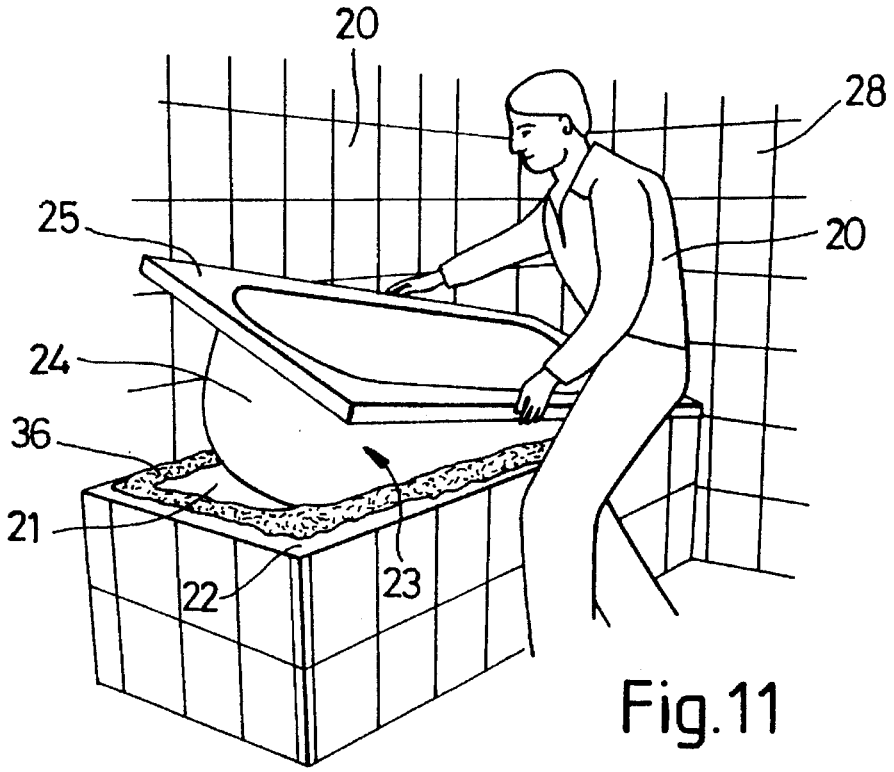
Figure 12:
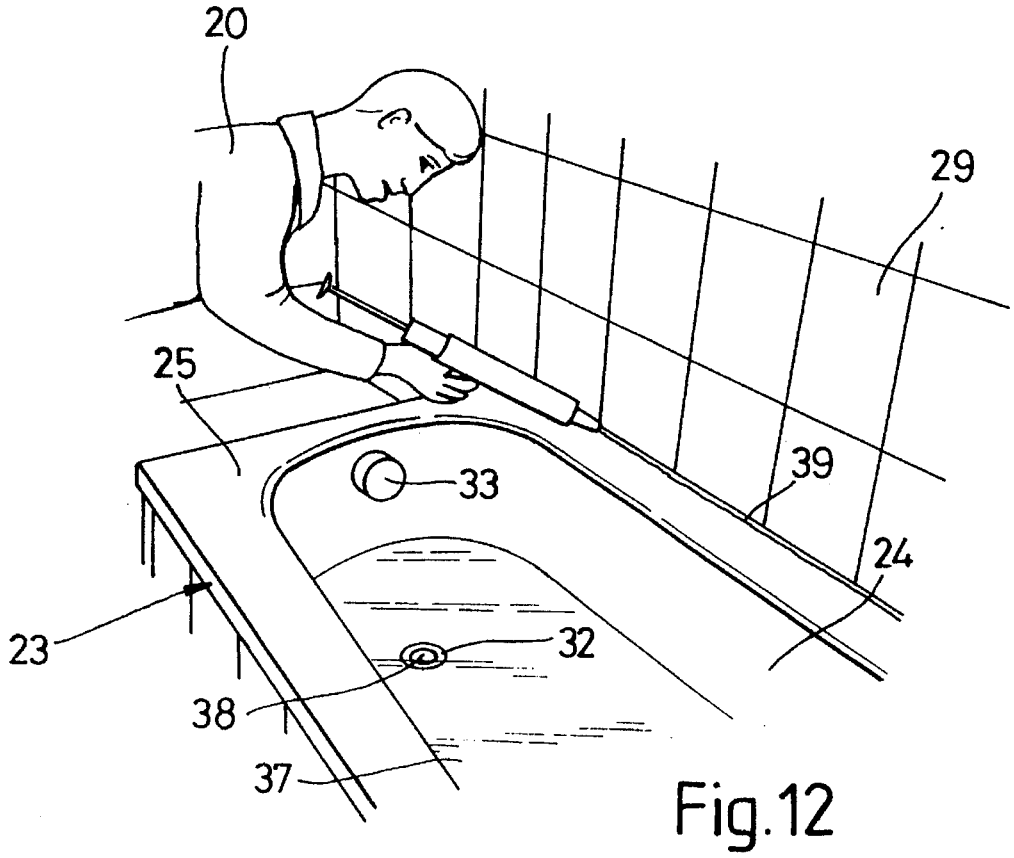

Before finally fitting the new bath in place, insulating adhesive filler 36 (FIG. 10) is applied to the bottom of the old tub 21 and to the existing surround 22. FIG. 11 shows the operator 20 putting the new bath 23 in place, after which he connects the new drain and overflow fittings 32, 33 to the new bath tub 24, and also runs water 37 into the bath tub 24 (after inserting a plug 38 in the drain fitting 32) to load the new bath while the filler 36 sets between it and the old bath. FIG. 12 shows this latter step and also shows the operator 20 filling the joint between the surround 25 of the new bath 23 and an adjacent wall surface 29 with a sealant 39.

What I claim is:

1. A method of renovating an old bath comprising taking measurements of the bath tub and surround, selecting a new bath having a tub that will fit within the tub of the old bath and having a surround that will extend over all the surround of the old bath, cutting the surround of the new bath to suit any adjacent wall surface when the new bath tub is centralized in the old bath tub, cutting away a portion of the old tub around the drain and overflow fittings, removing the fittings and the cutaway portion of old tub, installing new drain and overflow fittings to suit holes cut in the new bath tub, applying insulating adhesive filler to at least the existing surround, fitting the new bath in place and connecting the new drain and overlow fittings to the new bath tub, and loading the new bath while the filler sets and adheres between the old and new baths.

2. A bath renovating method as in claim 1, wherein cutting away a portion of the old tub is confined closely to the area around the drain and overflow fittings.

3. A bath renovating method as in claim 2, wherein insulating adhesive filler is also applied inside the bottom of the old tub before the new bath is fitted in place.

4. A bath renovating method as in claim 1, wherein the new bath is made of plastics.

5. A bath renovating method as in claim 4, wherein the plastics is acrylic.

6. A bath renovating method as in claim 1, wherein the insulating adhesive filler is curable polyurethane foam, affording both heat and noise insulation.

7. A bath renovating method as in claim 1, wherein the old bath is located against both a side wall and an end wall, and a side and an end of the surround of the new bath is cut to fit against said side and end with the tub of the new bath centralized in the tub of the old bath.

8. A bath renovating method as in claim 1, wherein the old bath fits within an alcove, and both ends of the surround of the new bath are cut as well as one side.

9. A bath renovating method as in claim 1, wherein the old tub is further cut away to accommodate fittings on the new tub that could not be accommodated between the old tub and the new tub.

10. A bath renovating method as in claim 9, wherein insulating adhesive filler is also applied to remaining inner areas of the sides of the old tub before the new bath is fitted in place.

11. A bath renovating method as in claim 1, wherein the holes in the tub of the new bath for the drain and overflow fittings are cut on site, the positions for the holes for the new drain and overflow fittings being transferred to the new bath tub after cutting the surround of the new bath as necessary to allow for centralizing of the new bath tub in the old bathtub.

12. A bath renovating method as in claim 1, wherein loading of the new bath is effected by filling its tub with water.

13. A bath renovating method as in claim 1, wherein when the new bath has set in place, joints with adjacent wall surfaces are filled with a sealant.

* * * * *